US008850632B2

(12) United States Patent
Bullis et al.

(10) Patent No.: US 8,850,632 B2
(45) Date of Patent: Oct. 7, 2014

(54) BATHING ENCLOSURE WITH EASY TO ASSEMBLE COMPONENTS

(71) Applicant: Kohler Co., Kohler, WI (US)

(72) Inventors: Daniel R. Bullis, Madison, WI (US); Daniel J. Lee, Monticello, WI (US); Jake W. Myre, Beaver Dam, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 13/713,965

(22) Filed: Dec. 13, 2012

(65) Prior Publication Data

US 2013/0097842 A1 Apr. 25, 2013

Related U.S. Application Data

(63) Continuation of application No. 12/208,447, filed on Sep. 11, 2008, now Pat. No. 8,332,972.

(51) Int. Cl.
*A47K 3/02* (2006.01)
*A47K 3/30* (2006.01)

(52) U.S. Cl.
CPC ... *A47K 3/02* (2013.01); *A47K 3/30* (2013.01); *A47K 2003/305* (2013.01)
USPC ..... 4/584

(58) Field of Classification Search
CPC ..... A47K 3/00; A47K 3/02
USPC ..... 4/538–595; 29/428
See application file for complete search history.

(56) References Cited

U.S. PATENT DOCUMENTS

| | | | | |
|---|---|---|---|---|
| 1,781,692 | A | 11/1930 | Lewis | |
| 1,928,924 | A * | 10/1933 | Barce | 52/264 |
| 2,282,362 | A | 5/1942 | Johnson | |
| 2,343,201 | A | 2/1944 | Nilson | |
| 2,648,409 | A | 8/1953 | Daugherty et al. | |
| 4,152,789 | A | 5/1979 | Heath | |
| 4,384,377 | A | 5/1983 | Calvert et al. | |
| 4,457,031 | A | 7/1984 | Moore | |
| 4,471,501 | A | 9/1984 | Heymann | |
| 4,539,721 | A | 9/1985 | Moore | |
| 4,817,344 | A * | 4/1989 | Wissinger | 52/35 |
| 4,901,380 | A | 2/1990 | Smith | |
| 4,987,619 | A | 1/1991 | Smith | |
| 5,263,208 | A | 11/1993 | Smith | |
| 6,425,147 | B1 * | 7/2002 | Hanson | 4/584 |
| 6,647,563 | B1 | 11/2003 | Smith | |
| 6,698,037 | B2 | 3/2004 | Lippe | |

(Continued)

FOREIGN PATENT DOCUMENTS

DE 20319339 U 1/2004

OTHER PUBLICATIONS

PCT Search Report and Written Opinion for PCT International Application No. PCT/US2009/004571 dated Jul. 12, 2009; 9 pages.

*Primary Examiner* — Lori Baker
(74) *Attorney, Agent, or Firm* — Foley & Lardner LLP

(57) ABSTRACT

A method for assembling a bathing enclosure includes providing a base on a support, the base having an upper rim. The method includes providing a first wall on the upper rim of the base, providing a second wall in pivotable engagement with the first wall at upper portions thereof, and pivoting the second wall relative to the first wall to mount the second wall on the upper rim of the base.

19 Claims, 11 Drawing Sheets

(56) References Cited

U.S. PATENT DOCUMENTS 7,490,371 B2 * 2/2009 Torres ..... 4/613
8,332,972 B2 * 12/2012 Bullis et al. ..... 4/584
2002/0157325 A1 * 10/2002 Domanico ..... 52/35
2004/0045225 A1 3/2004 Weiss
2010/0058531 A1 * 3/2010 Bullis et al. ..... 4/584
2013/0097842 A1 * 4/2013 Bullis et al. ..... 29/428

* cited by examiner

FIG. 20
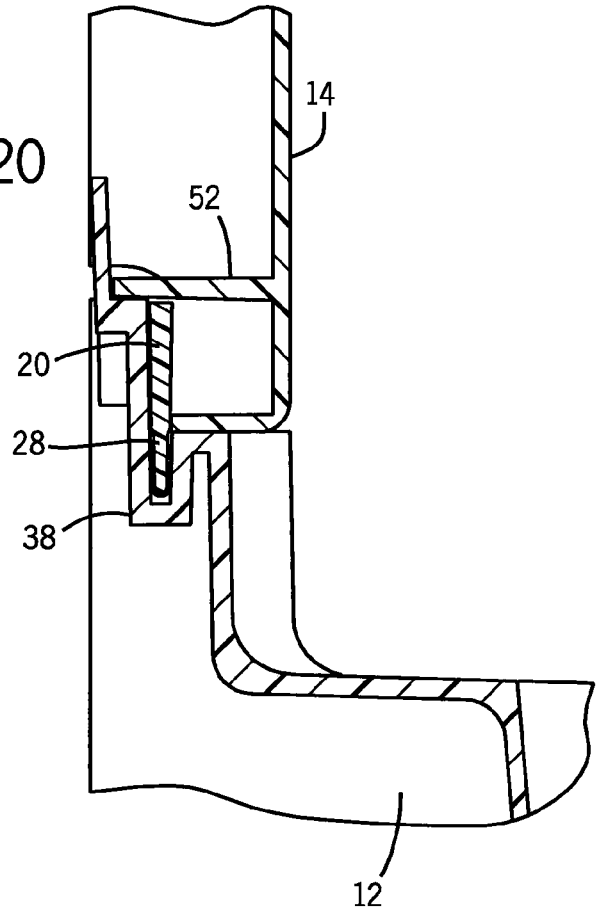
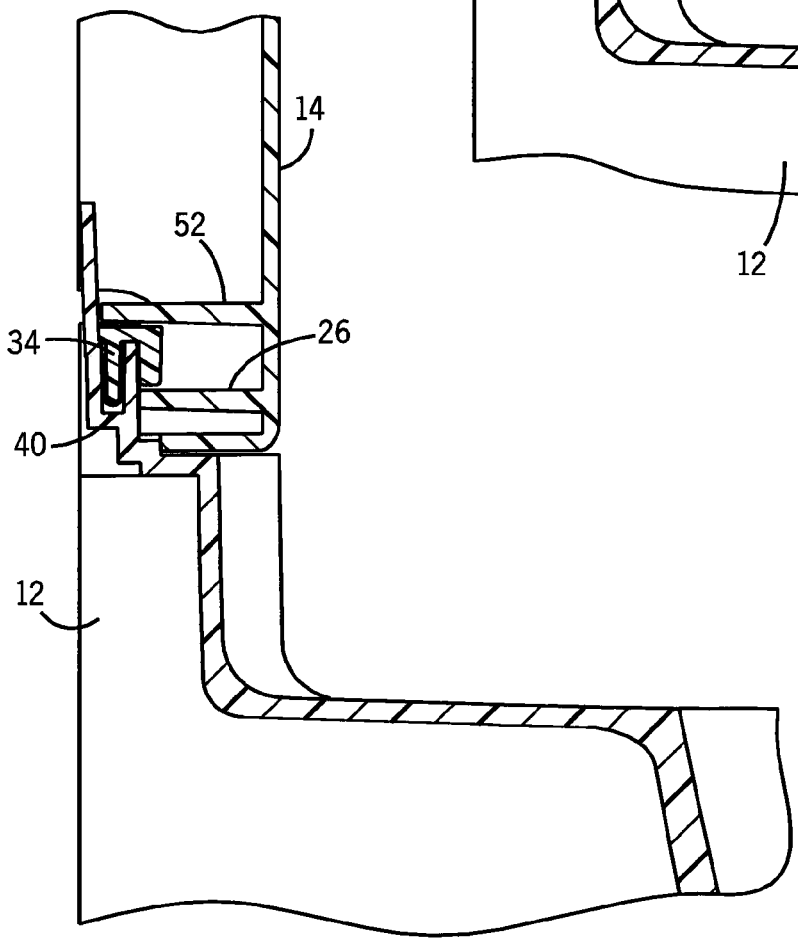
FIG. 21

BATHING ENCLOSURE WITH EASY TO ASSEMBLE COMPONENTS

CROSS-REFERENCE TO RELATED APPLICATION

The present application is a continuation of U.S. patent application Ser. No. 12/208,447, filed Sep. 11, 2008 (now U.S. Pat. No. 8,332,972), the entire disclosure of which is incorporated herein by reference.

STATEMENT OF FEDERALLY SPONSORED RESEARCH OR DEVELOPMENT

Not applicable.

BACKGROUND

The present invention relates to plumbing enclosures which are manufactured in multiple pieces and then assembled at the site of installation (often referred to as "knockdown" type enclosures). More particularly it relates to such enclosures which can be assembled without the use of separate clamps, and largely without the use of tools.

Bathtubs are sometimes designed with integral surrounding shower enclosure walls. Similarly, shower enclosures often have a receptor base/pan formed integrally with surrounding shower enclosure walls. However, the resulting enclosures can be so large that they will not fit through standard doorways or in standard elevators, thereby limiting their use with respect to the replacement market, and in any event making shipment of such products more difficult.

Hence, a variety of enclosures have been developed with the tub or shower pan formed separately from the surrounding enclosure walls. The components are then assembled at the site of installation, often using separate clamps, bolts, screws and/or tools.

For example, U.S. Pat. No. 2,343,201 discloses a knockdown shower enclosure with a horizontal mounting flange and three vertical walls. This design requires screws to interconnect the walls to the flange, which fasteners are time consuming to install. Further, the multitude of such fasteners complicates the installation as instructions are required illustrating the alignment of parts to be joined, what fasteners to use, etc.

U.S. Pat. No. 4,384,377 discloses a tub-shower enclosure which includes back wall and side wall panels which are molded with integral interlocked portions respectively thereon. The side wall panel can be assembled with the back wall panel to provide firm engagement there between by the interengaging of the interlocked portions with each other.

Specifically, a tongue portion which runs along the vertical edge of each side wall is inserted into a corresponding groove in the edge of the back wall panel. Further, dowel portions on the side walls fit within corresponding pockets in the edge of the back wall panel. This design has the disadvantage that the tongues, grooves, dowels, and pockets need to simultaneously aligned for proper assembly, which can be difficult. Additionally, it can be difficult to disassemble in the event of a repair, as the tongues and grooves have a substantially surface area in mutual contact, which surface area can become melded with calcium deposition from tap water for example, or other sediment, making them difficult to separate.

See also U.S. Pat. Nos. 1,781,692, 2,282,362, 2,648,409, 4,152,789, 4,471,501, 4,457,031, 4,539,721, 4,901,380, 4,987,619, 5,263,208, 6,647,563, and 6,698,037 for other enclosure structures.

Apart from issues of cost imposed by multi-part and complicated assembly features such as clamps, bolts and the like, a significant issue with such knockdown enclosures relates to insuring the watertight nature of the seams between the parts. In some cases this can require the use of caulk. In other cases this can require very close manufacturing tolerances.

Hence, while a variety of multiple piece type bathing and shower enclosures are known, it is desired to develop improved knockdown plumbing fixtures.

SUMMARY

A method for assembling a bathing enclosure includes providing a base on a support, the base having an upper rim. The method includes providing a first wall on the upper rim of the base, providing a second wall in pivotable engagement with the first wall at upper portions thereof, and pivoting the second wall relative to the first wall to mount the second wall on the upper rim of the base.

A method of assembling a bathing enclosure includes providing a base on a support, the base having an upper rim. The method includes providing a first wall, and inserting a projection that is coupled to a bottom end of the first wall into a recess in the upper rim of the base.

A plumbing fixture enclosure has a bathtub or shower receptor and enclosure walls. The lower tub/receptor has an upper rim on which rests a rear wall. A side wall is pivotably connected at its upper rear to an upper front side of the rear wall and then pivots downwardly to create a horizontal watertight seal between the side and rear walls. Simultaneously, a lower retaining finger at the front bottom of the side wall catches between an insert on the upper rim and the upper rim.

In one aspect the present invention provides a plumbing fixture enclosure formed of multiple pieces. The enclosure has a base having an upper rim, a first side wall mountable on the upper rim, and a second wall mountable on the upper rim abutting the first side wall.

The first side wall is pivotable along an essentially horizontal axis by virtue of a pivot joint between upper edges of the first side wall and the second wall. In preferred forms the pivot joint is in the form of an upwardly open receiving pocket on one of said walls and a pivot member on the other insertable in the receiving pocket. An opposite end of the first side wall (opposite an end where the pivot joint is) is provided with a lower retainer that links to the base as the first side wall pivots relative to the second wall to an essentially horizontal position. There is an insert mounted to the upper rim which facilitates linking the retainer to the base as the first side wall pivots relative to the second wall.

The insert may have a recess and projection connection with respect to the upper rim (e.g. a tang projects downward into a corresponding receiving area of the base upper rim). The tang on the insert has mounted thereon (or formed integrally therewith) a clip to facilitate frictional engagement of the tang with the receiving area of the base upper rim. The insert also has a downwardly projecting sloped ramp suitable to guide and catch a lower sloped finger portion of the retainer.

The two walls have abutting structures to facilitate a serpentine recess and projection seam/joint between them when they are assembled together in facing fashion. There may also be a third wall mountable on the upper rim of the base, wherein the third wall is similarly pivotable along an essentially horizontal axis by virtue of a pivot joint between upper edges of the third and second walls.

The second wall is preferably a rear enclosure wall, and the first and third walls are preferably opposed (e.g. left and right)

side enclosure walls. For example, the enclosure can be a combined bathtub and shower enclosure.

In another aspect the invention provides a method of assembling a plumbing fixture enclosure. One positions a bathtub on a floor or other essentially horizontal support, mounts a rear wall of a shower enclosure on an upper edge of the bathtub, links an upper edge of an enclosure side wall to an upper edge of the rear wall while the side wall is not essentially horizontal, and then pivots the side wall to an essentially horizontal position so as to thereby create an essentially watertight seam between the rear and side wall. This essentially simultaneously automatically also links a frontal lower edge of the side wall to the bathtub.

It should be appreciated that by using the present invention the enclosure walls can be assembled in watertight fashion quickly, and without the use of any tools. No additional clamps on the outside of the side and rear walls are needed. Hence, there is a considerable labor and material saving.

These enclosures nevertheless still serve all the primary needed functions for a knockdown enclosure. They can be manufactured in multiple parts, and thus more easily be shipped to the installation site. When it is desired to inspect or repair plumbing or other structures behind the enclosure, even long after installation, the enclosure side walls can be disassembled from the tub or shower base (by reversing the pivoting) with less risk of damaging the base or other enclosure walls. After the maintenance work, the surround can be reassembled to the base.

The above-mentioned and other features and advantages of this invention will become more apparent and the invention will be better understood by reference to the following description of the preferred embodiment of the invention, taken in conjunction with the accompanying drawings.

BRIEF DESCRIPTION OF THE DRAWINGS

FIG. 20 is a view taken along section line 20-20 in FIG. 19; and

FIG. 21 is a view taken along section line 21-21 in FIG. 19.

DETAILED DESCRIPTION

Figure 1:
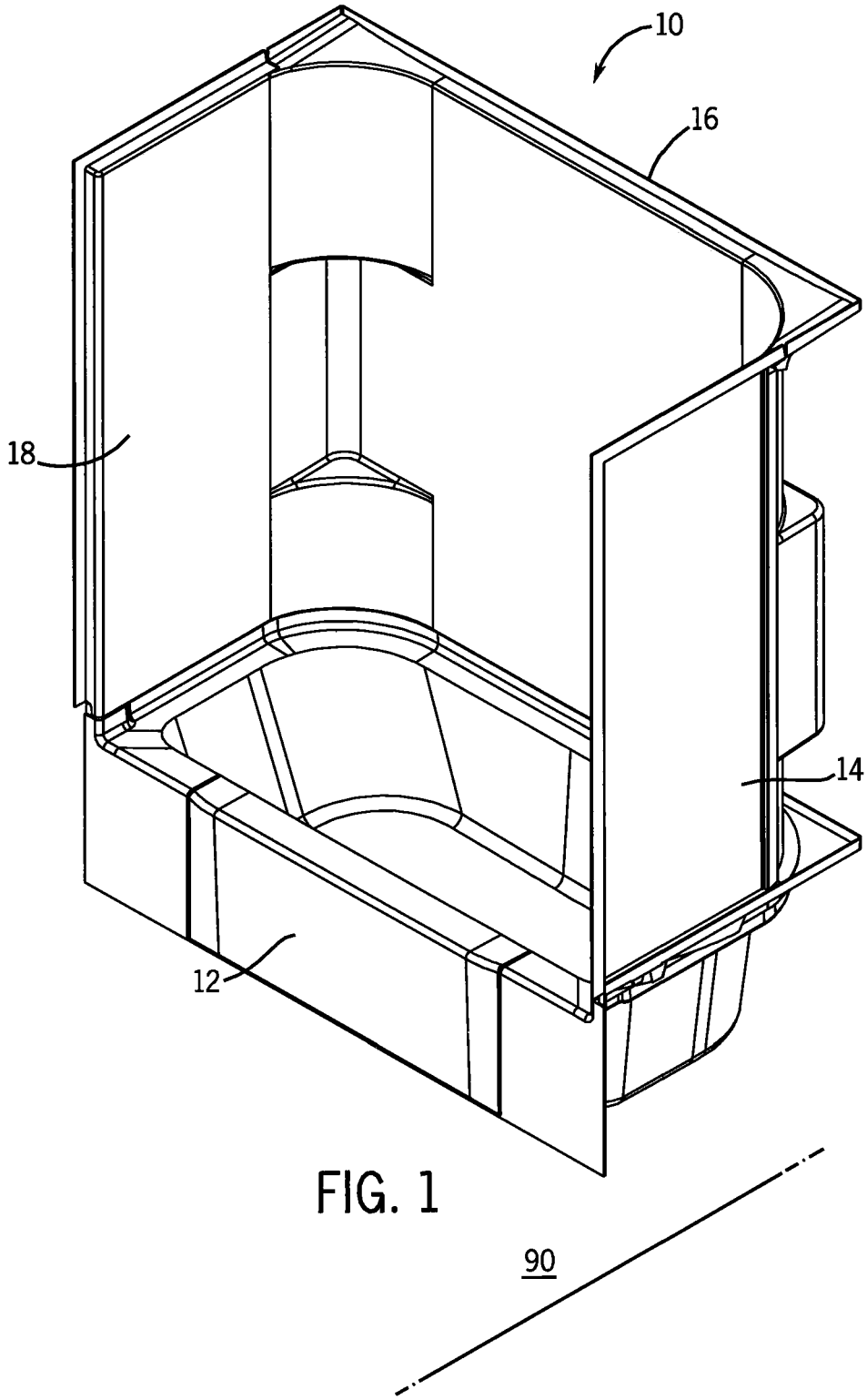
FIG. 1 is a right, upper, frontal perspective view of an enclosure of the present invention.
Figure 2:
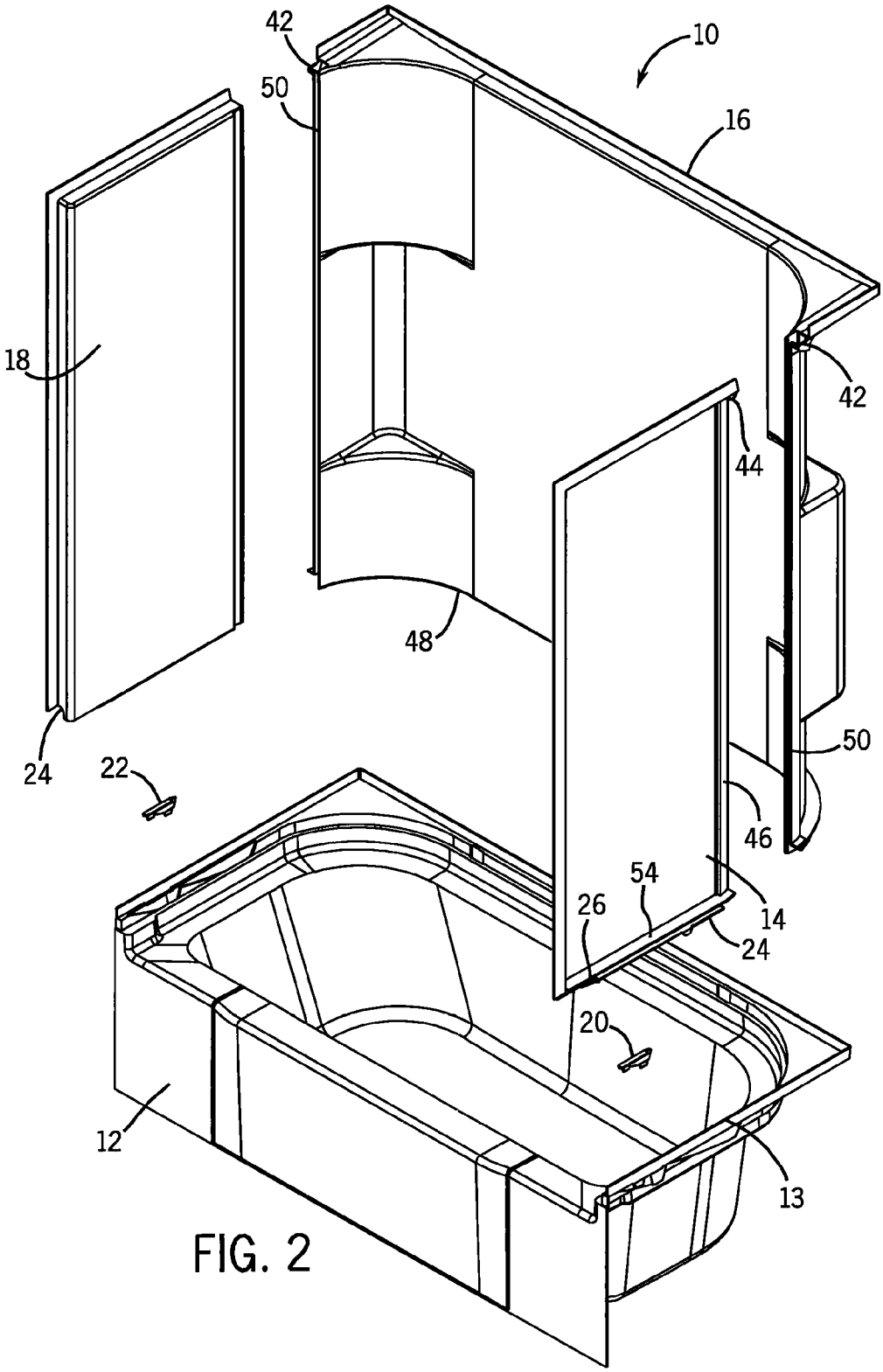
FIG. 2 is an exploded perspective view of the enclosure of FIG. 1.
Figure 5:
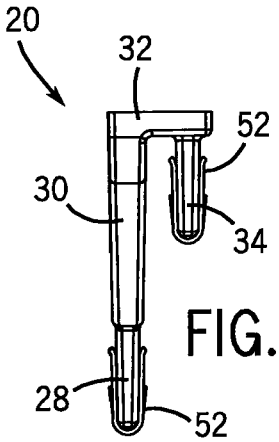
FIG. 5 is an end view of the FIG. 3 insert.
Figure 3:
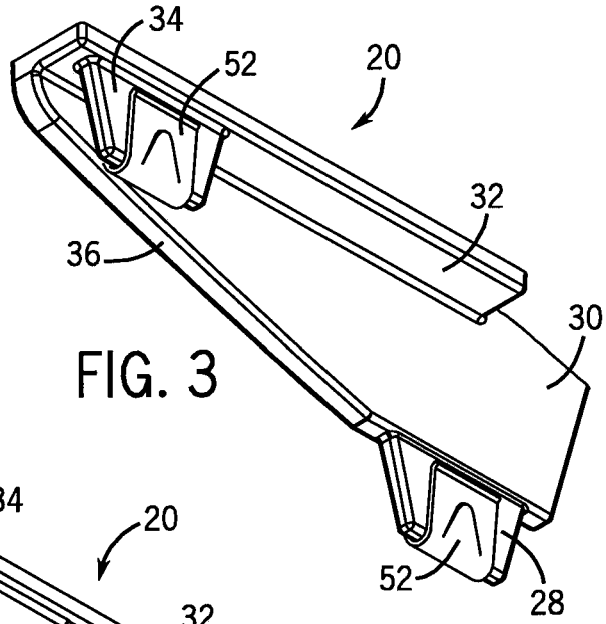
FIG. 3 is a perspective view of an insert that facilitates assembly of the enclosure components.
Figure 4:
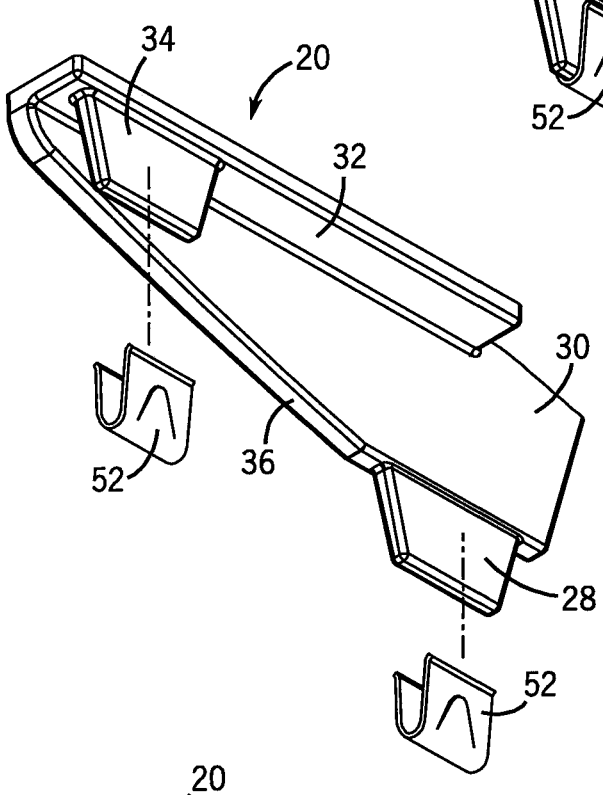
FIG. 4 is an exploded view of the FIG. 3 insert.
Figure 6:
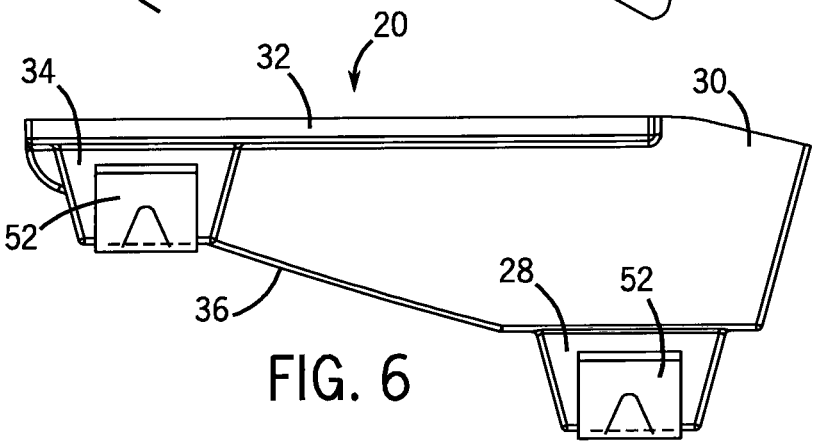
FIG. 6 is a side view of the FIG. 3 insert.
Figure 7:
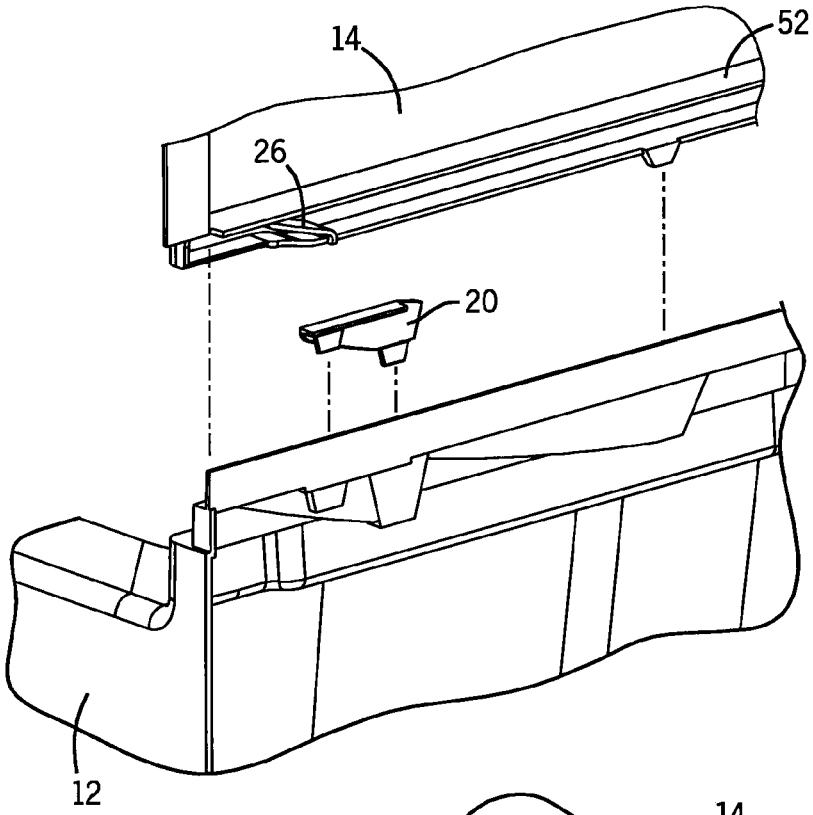
FIG. 7 is a fragmentary exploded perspective view illustrating assembly of a tub/shower wall joint of the enclosure.
Figure 9:
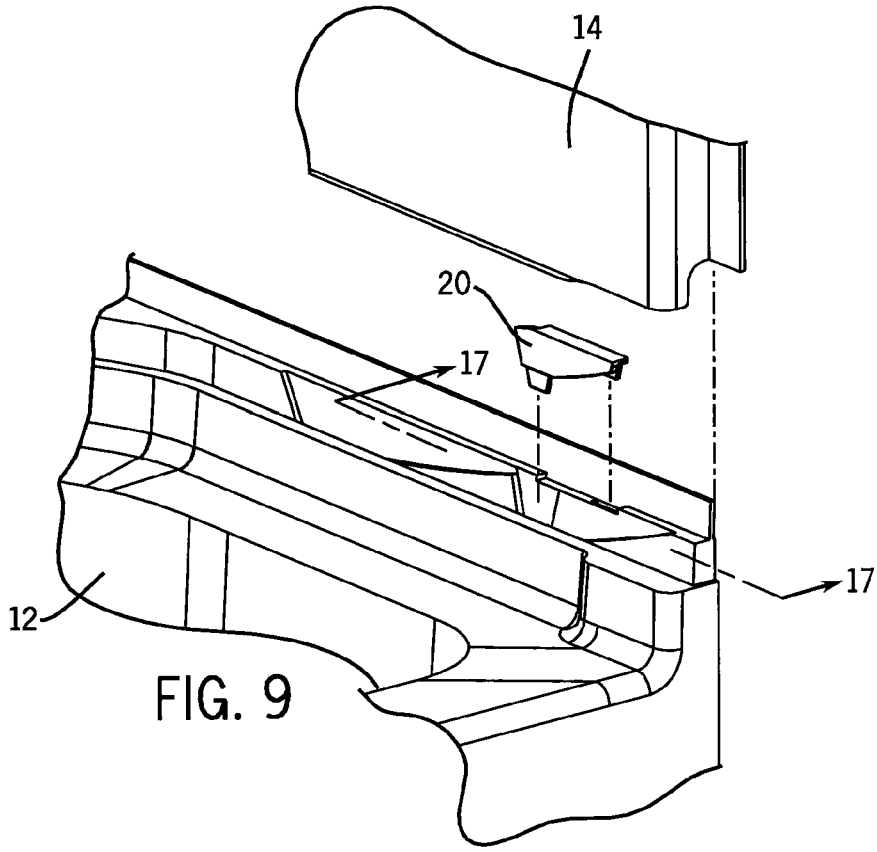
FIG. 9 is yet another exploded perspective view, focusing on another view of the FIG. 7 assembly.

Referring first to FIGS. 1 and 2, there is shown a combined shower and bathtub enclosure 10 which includes a bathtub 12 having an upper rim 13, on which is positioned a first shower enclosure side wall 14, a shower enclosure back wall 16 (a "second wall"), and another opposed shower enclosure side wall 18 (a "third wall"). The walls 14/16/18 are joinable together to form a shower enclosure portion above the bathtub 12.

While this patent uses the term "enclosure" or "surround", it is to be understood that such structures do not always, or even frequently, completely surround or enclose the showering/bathing areas. Instead, a door structure or a curtain, not shown, typically completes the structure. Instead, we use these terms to refer to the fixture with or without these extra final closing features.

Inserts 20 and 22 are positioned on upper rim 13 to catch the frontal bottom of the opposed side walls 14 and 18, as will be discussed below. Walls 14 and 18, and inserts 20 and 22, are respectively mirror images of each other.

Enclosure walls 14 and 18 include a lower edge 24. Note especially that they have a sloping retainer/finger/projection 26 at their frontal end.

Turning now to FIGS. 3-6 each insert 20, 22 has a tang 28 extending from a main body 30, a flange 32 extending transversely from the main body 30, and a second tang 34 extending transversely from the flange 32. Main body 30 includes a ramped edge 36 extending approximately from first tang 28 past second tang 34.

Tangs 28 and 34 are inserted into respective receiving pockets 38, 40 at the upper edges of the bathtub. See e.g. FIGS. 17, 20 and 21. Tang 28 and tang 34 include a trapezoidal outer contour which facilitates insertion. Retaining clips 52 (each preferably with one-way barbed sides) may be mounted on the tangs to further help retain inserts 20, 22 in their respective receiving pockets 38, 40.

Figure 8:
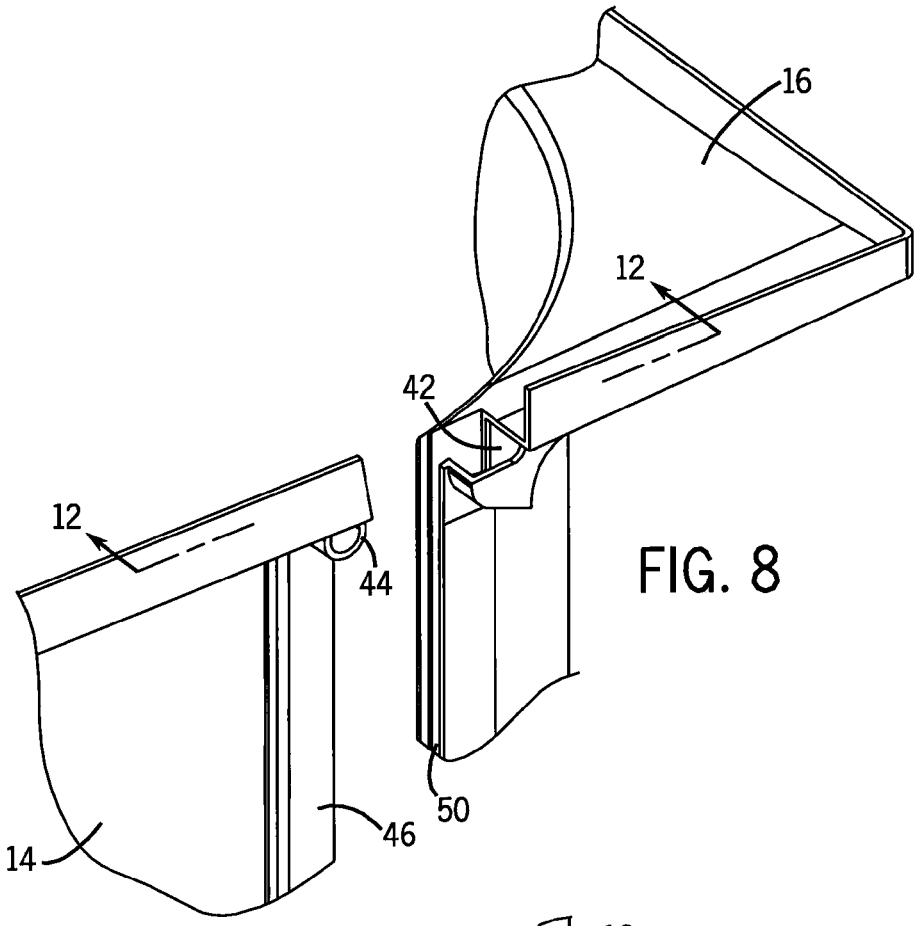
FIG. 8 is another fragmentary exploded perspective view, focusing on assembly of two adjacent shower wall portions of the enclosure near their upper ends.

Referring next to FIG. 8, back wall 16 includes two receiving pivot pockets 42 at upper forward edges of back wall 16. Side walls 14 and 18 include a rear upper pivot element 44. Rear upper pivot elements 44 are designed to engage the corresponding receiving pivot pockets 42 to pivot the side walls 14 and 18 from the FIG. 11 position to the FIG. 12 position, and then to the FIG. 13 position. As this occurs (to connect the upper portion of the side walls to the rear wall), the projection 26 at the lower frontal end of the side walls will interface with a corresponding ramped edge 36 (FIGS. 17-21).

Figure 10:
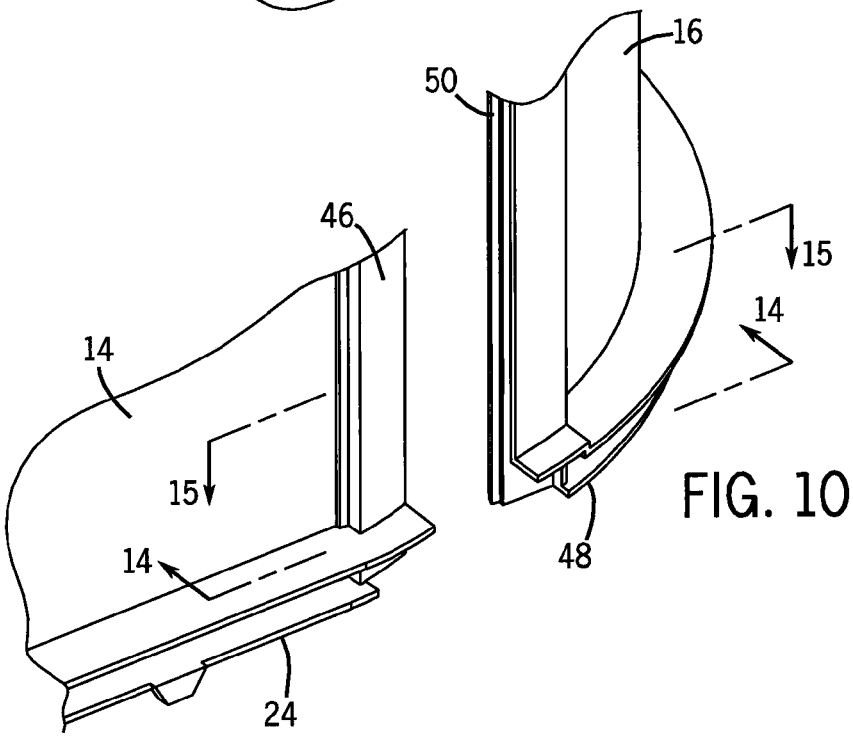
FIG. 10 is another fragmentary exploded perspective view, focusing on assembly of two adjacent shower wall portions of the enclosure near their lower ends.

Side walls 14 and 18 each include an approximately planar rear edge 46 approximately extending from rear upper pivot element 44 to first base edge 24 of walls 14, 18. As shown in FIG. 10, back wall 16 has a lower edge 48 configured for adjoining bathtub 12, and includes slots 50 approximately extending from a respective receiving pivot pocket 42 to lower edge 48.

Figure 15:
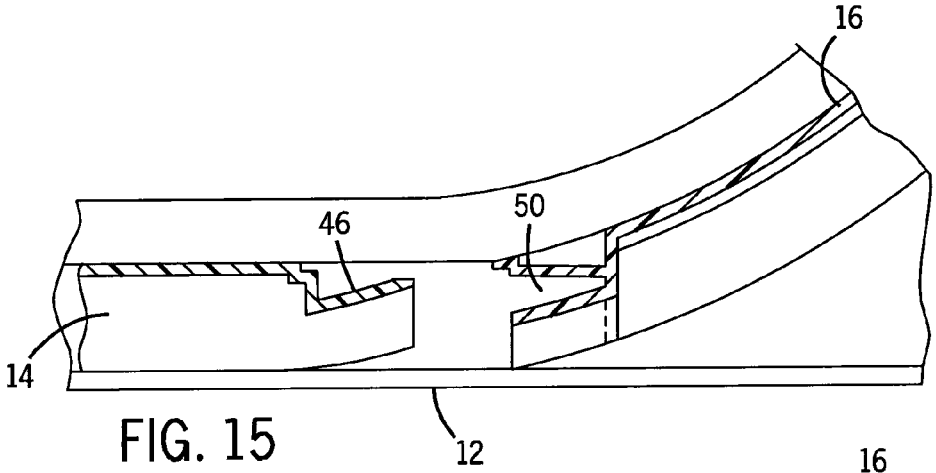
FIG. 15 is a cross-sectional view taken along line 15-15 of FIG. 10.
Figure 16:
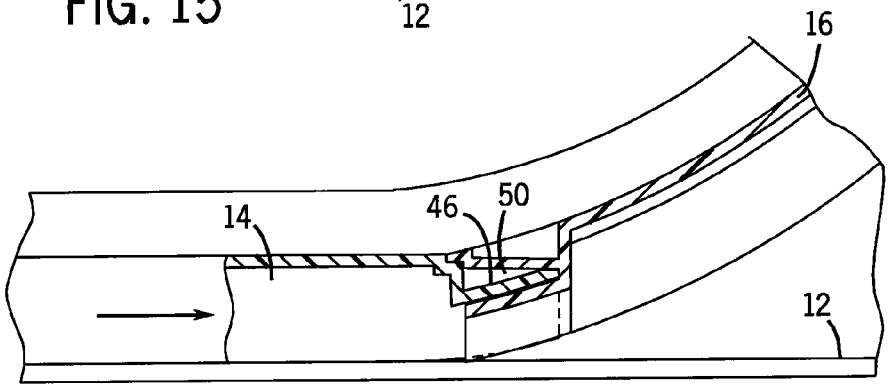
FIG. 16 is a view similar to FIG. 15, but illustrating a further stage of assembly.

The planar edge 46 of each side wall 14, 18 is inserted into a respective slot 50 when the side walls 14, 18 are in an assembled position with enclosure back wall 16. See e.g. FIGS. 15 and 16.

Note in particular that planar edges 46 (once inserted in respective slots 50) provides a labyrinth path which prevents water in the enclosure from leaking through the joint/seam. Additionally, the wide mouth of slot 50 allows for relatively easy insertion of edges 46 into the slots.

Figure 17:
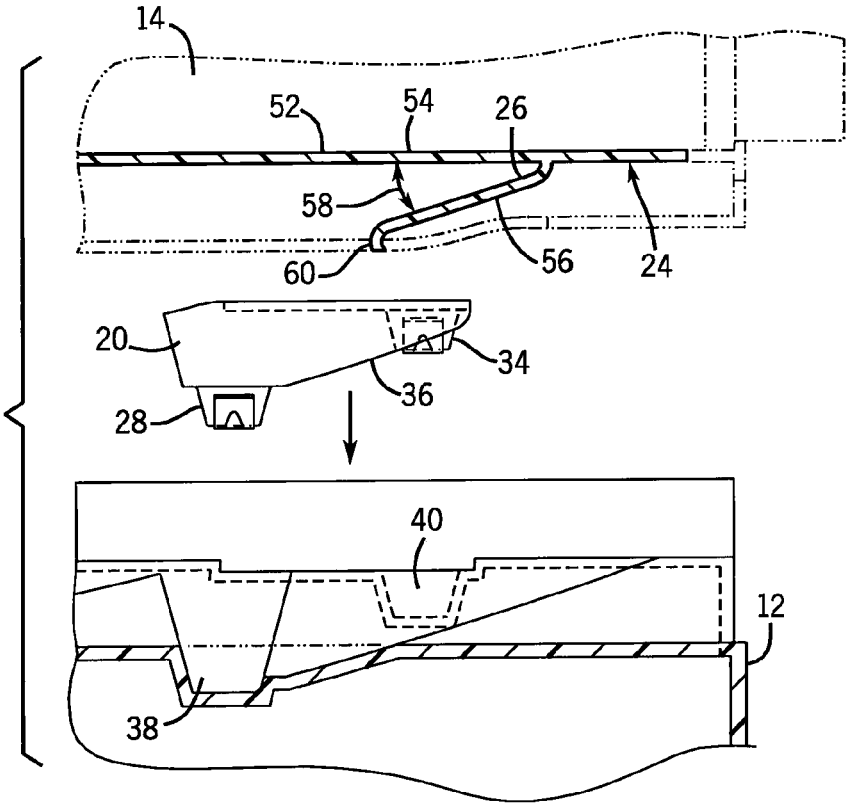
FIG. 17 is a view taken along line 17-17 in FIG. 9.
Figure 19:
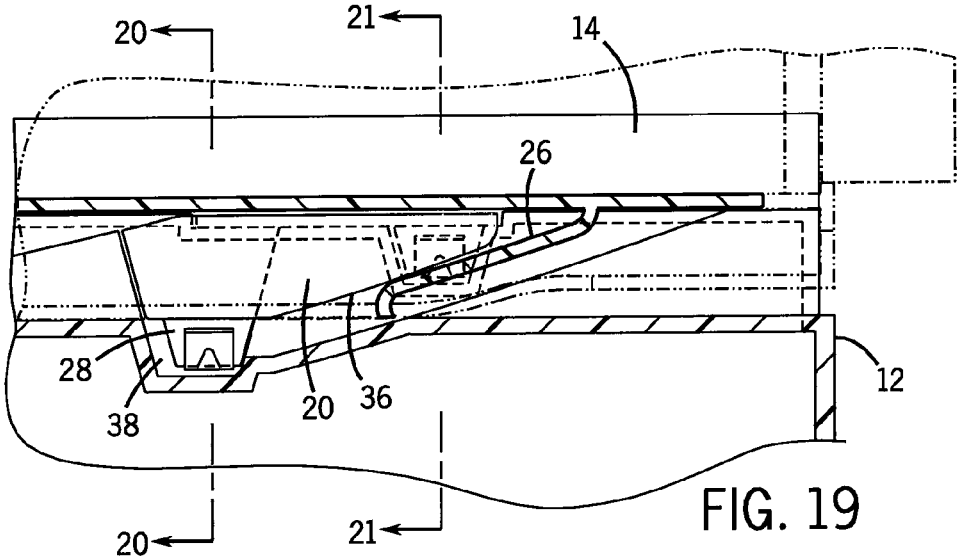
FIG. 19 is a view similar to FIG. 18, illustrating an even further state of assembly.

As shown in FIGS. 2 and 17, edge 24 on the bottom of side wall 14 includes a ledge 54 extending transversely, and projection 26 can include a linear retainer portion 56 extending from ledge 54 at an acute angle 58, and a curved end portion 60.

The enclosure walls 14/16/18, and the bathtub 12, can be formed by conventional molding techniques, preferably from plastic materials such as acrylics or fiberglass. Inserts 20 can injection molded with plastics or other materials. Retaining clip 52 may be metallic or alternatively be integrally fabricated with insert 20 during the molding or other fabrication process.

Figure 11:
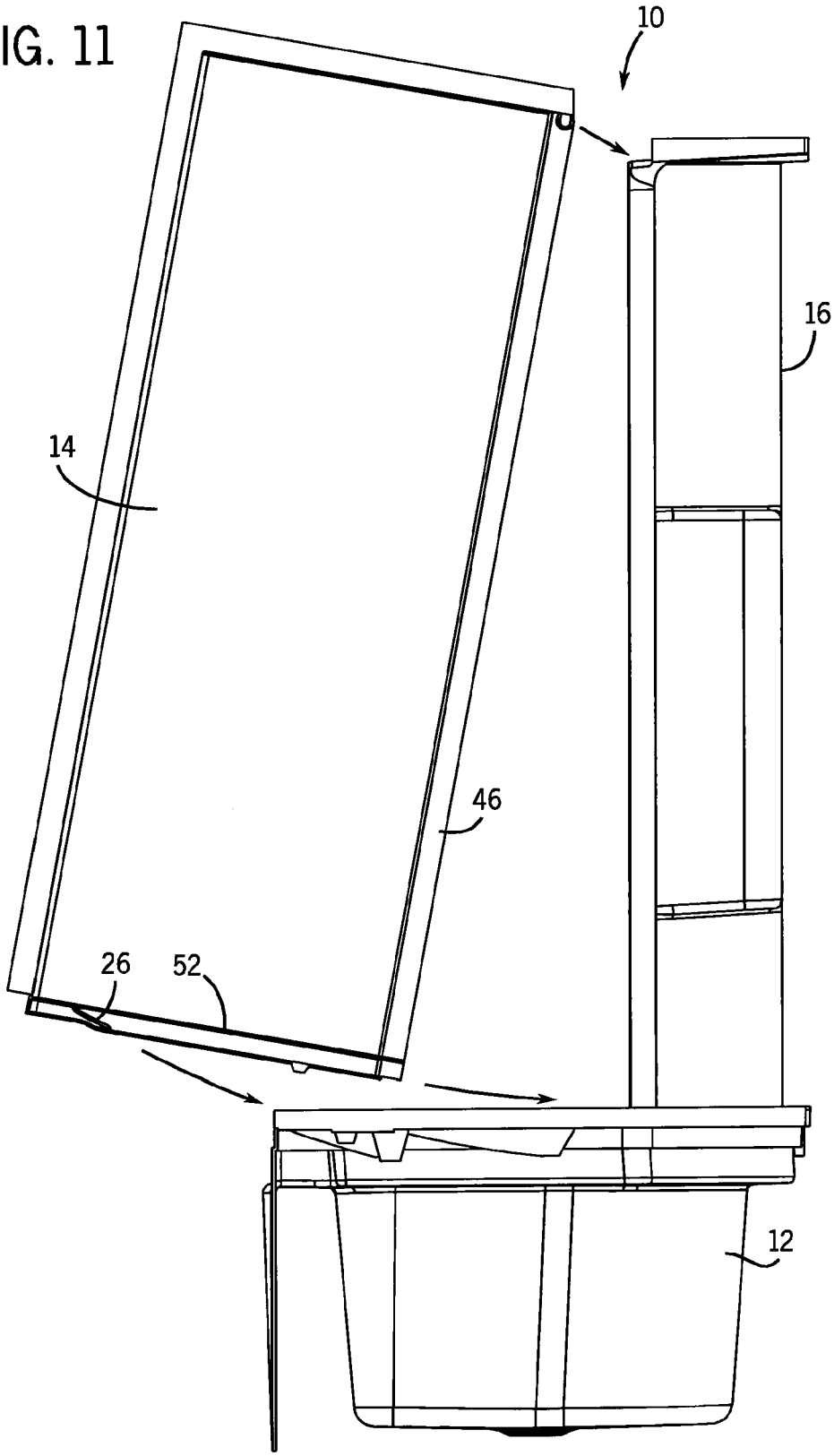
FIG. 11 is a view from a right side of the enclosure, showing a right shower wall being assembled to the bathtub.
Figure 12:
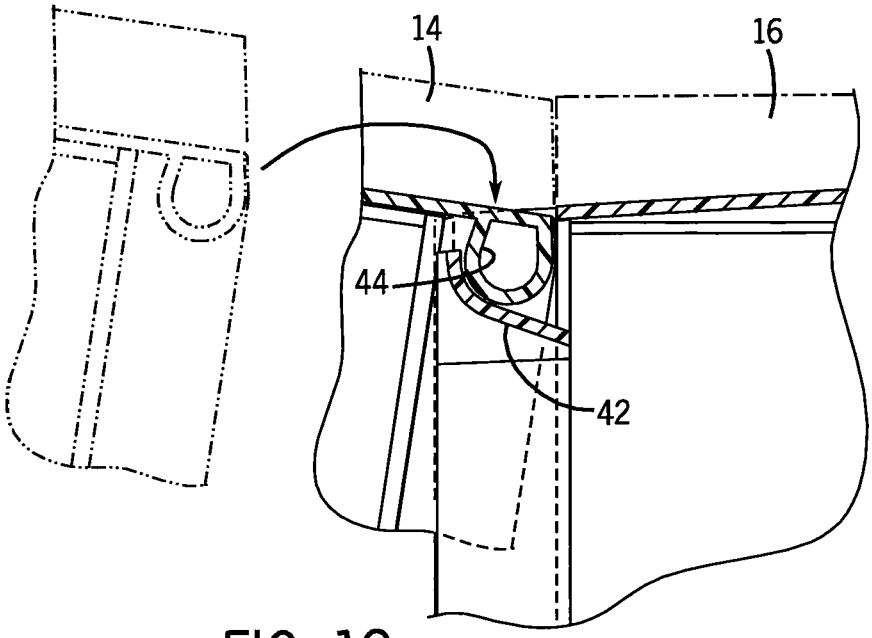
FIG. 12 is a cross-sectional view taken along line 12-12 of FIG. 8, once the FIG. 8 parts have been further assembled.
Figure 13:
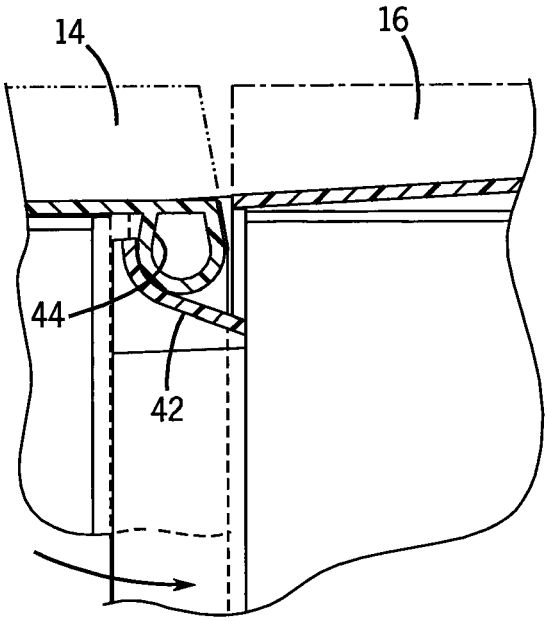
FIG. 13 is a view similar to FIG. 12, after further relative pivoting of the parts.
Figure 14:
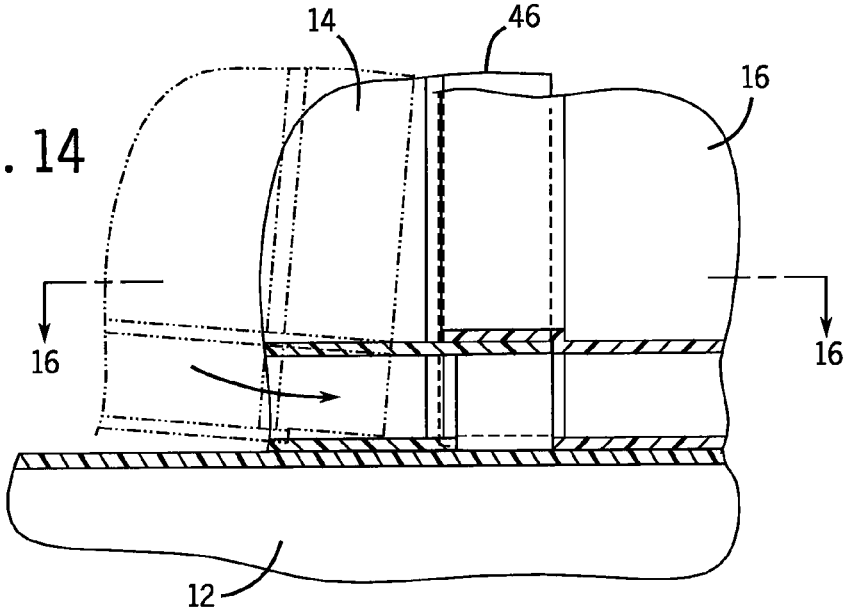
FIG. 14 is a cross-sectional view taken essentially along line 14-14 of FIG. 10, after the parts have been further assembled.

When one wants to assemble the bathing/shower enclosure after the pieces have been moved to the installation site, one installs the bathtub 12 on a horizontal floor 90 or other essentially horizontal support. One then drops the back wall 16 down onto the upper rim 13 of the bathtub. One then takes a side wall (14 or 18), places its rear upper pivot element 44 into the corresponding receiving pivot pocket 42, and pivots the side wall as shown in FIGS. 11-13. This creates a self-sealing joint between the side and rear wall.

Figure 18:
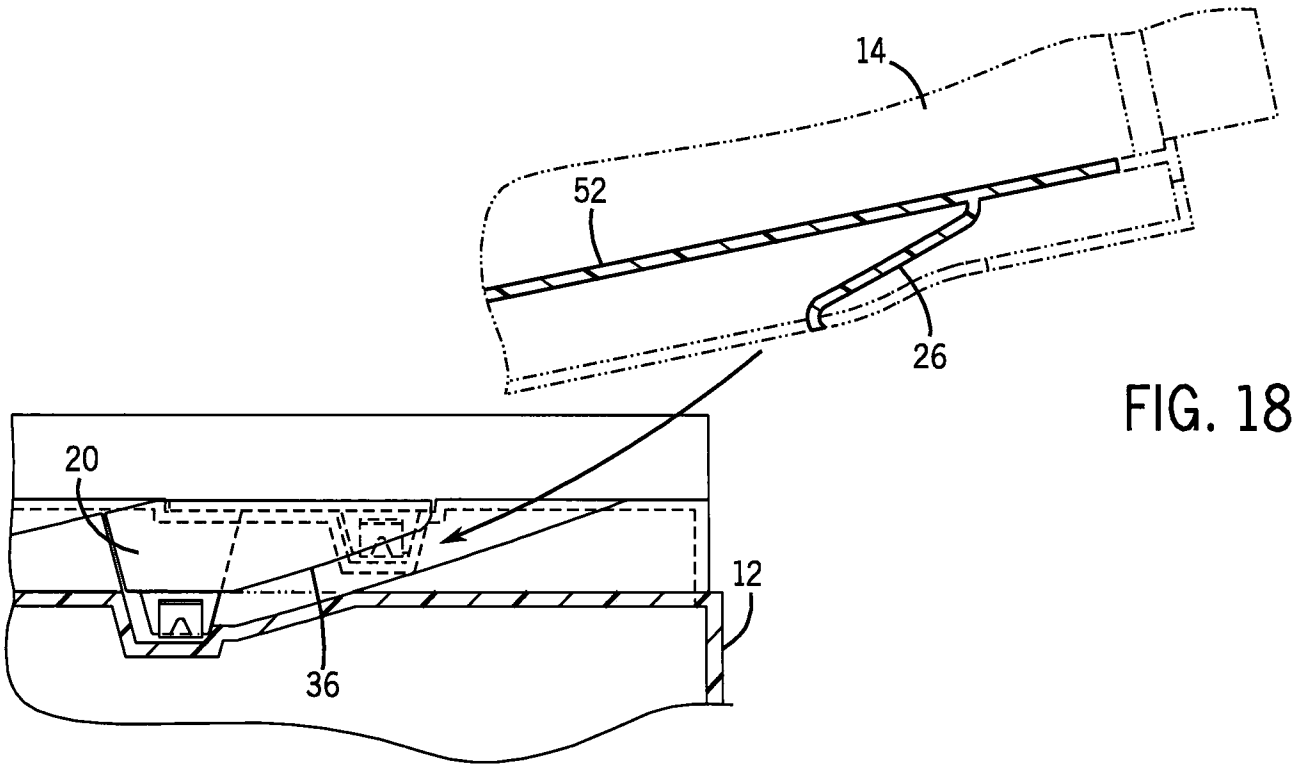
FIG. 18 is a view illustrating a further stage of assembly than the FIG. 17 illustration.

As this is occurring, the lower retainer 56/60, as shown in FIG. 18, slips into the slot between ramp 36 and the upper rim 13 of the bathtub. The frictional engagement between the clips 52 and the receiving pockets 38 and 40 help the clips resist return movement out of those pockets. If the clips are securely adhered to the corresponding tangs 34 and 28, that will also hold the inserts to the bathtub 12. That in turn, together with gravity, will tightly hold and wedge the linear portion 56, and thus the side wall to the top wall. The process is then repeated for the other side wall 18.

This all occurs without the need for any clamps or screws, and if maintenance access to the area behind the enclosure is ever needed the process can be reversed. Importantly, this is achieved without the need for caulk to assure watertight seams.

While a preferred embodiment of the invention has been disclosed, other modifications and variations will be apparent to those skilled in the art, which are intended to be within the spirit and scope of the invention. For example, while the invention has been depicted in the context of a combined bathtub/shower enclosure, it could also be used for a combined shower receptor and surrounding walls, or a combined sauna and wall surround.

Therefore, the present invention is not intended to be limited to just the described most preferred embodiments. To ascertain the full scope of the invention, the claims which follow should be referenced.

INDUSTRIAL APPLICABILITY

The invention provides multi-part plumbing fixture enclosures which can be easily assembled at the site of installation.

What is claimed is:

1. A method of assembling a bathing enclosure, comprising:

providing a base on a support, the base having an upper rim;

providing a first wall on the upper rim of the base;

providing a second wall in pivotable engagement with the first wall at upper portions thereof; and pivoting the second wall about a generally horizontal pivot axis relative to the first wall to mount the second wall on the upper rim of the base.

2. The method of claim 1, wherein providing the second wall in pivotable engagement with the first wall includes engaging an upper, rearward portion of the second wall with an upper, forward portion of the first wall.

3. The method of claim 1, wherein providing the second wall in pivotable engagement with the first wall includes placing a pivot element of the second wall into a receiving pocket of the first wall.

4. The method of claim 3, wherein the pivot element and the receiving pocket cooperatively define the generally horizontal pivot axis.

5. The method of claim 1, wherein pivoting the second wall relative to the first wall includes pivoting the second wall generally in a plane defined by the second wall.

6. The method of claim 1, wherein the generally horizontal pivot axis is located at an upper portion of the first wall.

7. The method of claim 1, wherein pivoting the second wall relative to the first wall includes moving a bottom end of the second wall rearward relative to the base.

8. The method of claim 1, wherein pivoting the second wall relative to the first wall includes engaging an end of the second wall with an end of the first wall.

9. The method of claim 8, wherein the end of the first wall is generally vertical.

10. The method of claim 8, wherein the end of the second wall includes a planar edge, and the end of the first wall includes an elongated slot that receives the planar edge when the end of the second wall engages the end of the first wall.

11. The method of claim 1, wherein pivoting the second wall relative to the first wall includes engaging a lower end of the second wall with the upper rim of the base.

12. The method of claim 1, further comprising inserting a projection that is coupled to a bottom edge of the second wall into a recess in the upper rim of the base.

13. The method of claim 12, wherein inserting the projection of the second wall into the recess of the base occurs simultaneous to pivoting the second wall relative to the first wall.

14. The method of claim 12, wherein providing the base includes providing an insert member in the recess of the base, and inserting the projection of the second wall into the recess of the base includes positioning at least a portion of the projection under the insert member.

15. The method of claim 14, wherein providing the insert member in the recess of the base includes positively coupling the insert member to the base.

16. The method of claim 1, wherein the base is a bathtub or a shower receptor.

17. A method of assembling a bathing enclosure, comprising:

providing a base on a support, the base having an upper rim with a recess therein;

providing an insert member in the recess and coupling the insert member to the base;

providing a first wall; and inserting a projection that is coupled to a bottom end of the first wall into the recess.

18. The method of claim 17, wherein inserting the projection of the first wall into the recess of the base includes sliding at least a portion of the projection under the insert member.

19. The method of claim 17, wherein inserting the projection of the first wall into the recess of the base includes rotating the first wall, and wherein the projection extends from the bottom end of the first wall in a radial direction relative to rotation of the first wall.

* * * * *